US005386990A

United States Patent [19]

Smith

[11] Patent Number: 5,386,990

[45] Date of Patent: Feb. 7, 1995

[54] GOLF COURSE TIMING METHOD AND SYSTEM

[76] Inventor: Matt H. Smith, 3247 Highlawn Dr., Twin Falls, Id. 83301

[21] Appl. No.: 175,197

[22] Filed: Dec. 28, 1993

[51] Int. Cl.[6] ..... A63B 69/36; G04F 3/02

[52] U.S. Cl. ..... 273/32 H; 368/97

[58] Field of Search ..... 273/32 R, 32 H; 368/89, 368/97, 98

[56] References Cited

U.S. PATENT DOCUMENTS

| | | | |
|---|---|---|---|
| 2,609,045 | 9/1952 | Kaiser | 368/89 X |
| 2,698,658 | 1/1955 | Coren | 368/97 |
| 2,797,863 | 7/1957 | Shepard, Jr. | 368/89 X |
| 4,303,243 | 12/1981 | Wolfe | 273/176 R |
| 5,086,390 | 2/1992 | Matthews | 364/410 |
| 5,097,416 | 3/1992 | Matthews | 364/410 |

*Primary Examiner*—William H. Grieb
*Attorney, Agent, or Firm*—Frank J. Dykas; Craig M. Korfanta

[57] ABSTRACT

Embodiments of a golf course timing method and system are shown and described. A countdown timer is carried by a golfer or flight of golfers to indicate the golfer's progress relative to an allotted maximum time for the total course and/or for each hole. Elapsed time or time left to play may be indicated. The timer may be programmed to account for different playing times for the various holes of the course. This programming may be done by programming an electronic timer, by printing a graphic design or arranging moveable blades on the timer face so that the clock hand points to the individual holes at the appropriate time, or by other methods. Alternatively, a printed schedule may be assigned to each flight of golfers. The golfers may then be made responsible for keeping up a smooth, consistent, and reasonable pace on the course, which relieves tension and allows more flights of golfers per day. The timer may be checked by golf course personnel on the course or may transmit signals to a clubhouse for monitoring at a distance.

7 Claims, 6 Drawing Sheets

GOLF COURSE TIMING METHOD AND SYSTEM

BACKGROUND OF THE INVENTION

1. Technical Field

This invention relates generally to the game of golf, and more specifically to a golf course timing system. The purpose of the timing system is to speed up slow players, keep groups of players moving on the golf course at a steady pace, and minimize congestion, delay and frustration on the course.

1. Related Art

Wolfe, U.S. Pat. No. 4,303,243, discloses timers positioned at each tee on the golf course. The timers indicate whether the golfers played the preceding hole faster, slower, or equal to the predetermined playing time.

Matthews, U.S. Pat. Nos. 5,086,390 and 5,097,416, disclose an electronic system for monitoring play of golfers from a centralized location like the pro shop. The system uses restricted range location transmitters on the golfers, receivers on the golfers and at the pro shop, and counters to measure the time spent by the golfers within the restricted transmission range at a particular hole.

Still, what is needed is a simple but effective method and system for encouraging steady play on golf courses which does not require timers at every tee or complex electronic communications equipment.

DISCLOSURE OF INVENTION

My invention is providing each group or flight of golfers with a countdown timer at the beginning of the course, for example, at the pro shop. The timer, which may display elapsed time or time left to play, or both, is programmed to account for different playing times for every hole on the course. This way, the flight of golfers will always know, anywhere on the course, whether they are ahead or behind schedule or on time. Also, this way an agent for the course may readily determine from examining the flight's timer whether the flight is ahead or behind schedule. If behind schedule, the flight may be escorted by the agent to a later spot on the course on schedule with the timer.

The timer may be electric, electronic or mechanical. Also, it may be provided separately to the golfers, or in the golf cart which is used by the flight of golfers. This latter way, the pace of the golfers may be easily monitored by golf course personnel by conveniently intercepting or locating the golfers' cart anywhere along the course.

BEST MODE FOR CARRYING OUT INVENTION

Figure 1A:
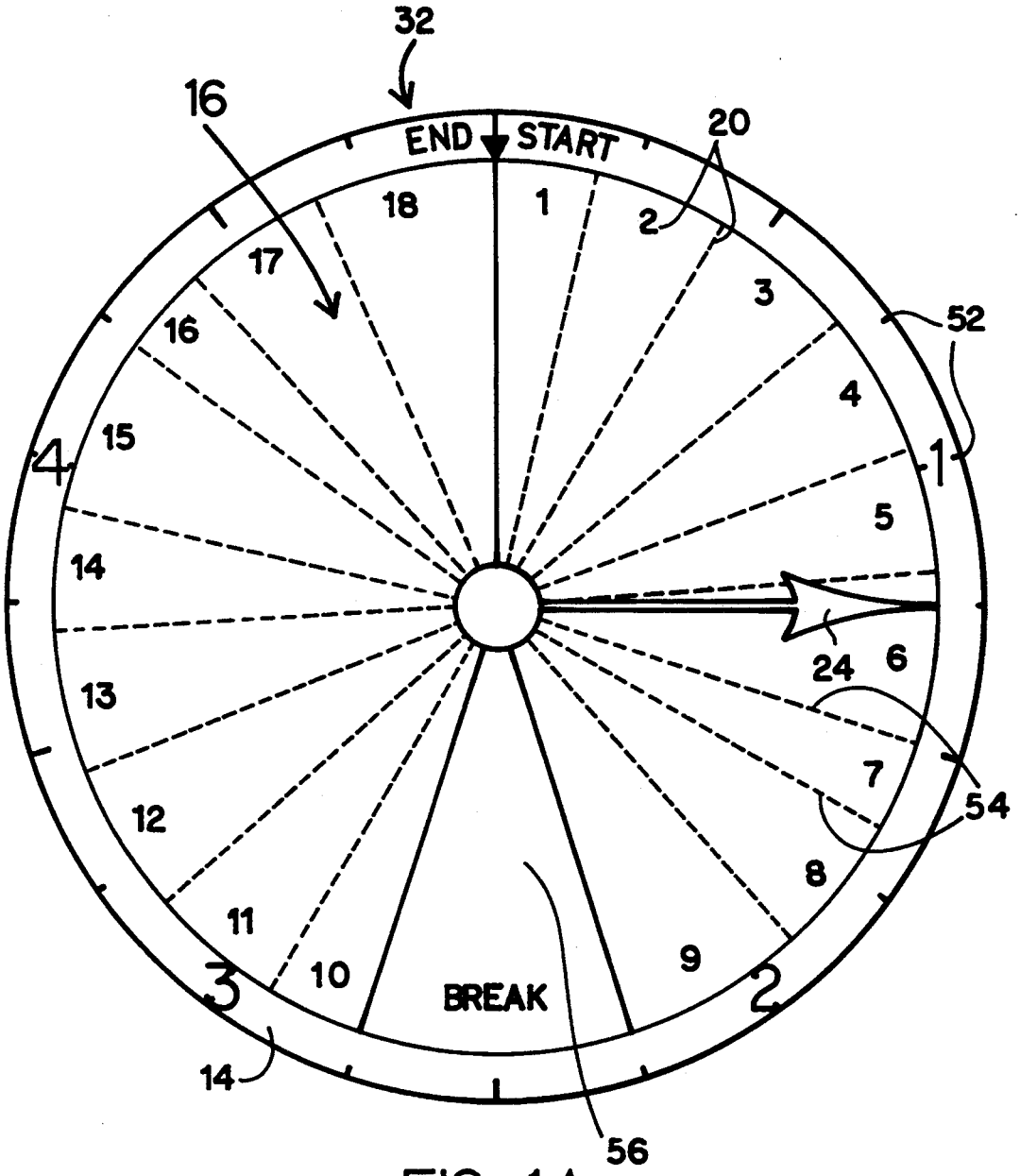
FIG. 1A is a front view of one embodiment of the timer device of the invention—a mechanical, wind-down timer with a clockwise moving pointer and graphic design on its face indicating the proper relationship between elapsed time and suggested position on the golf course.
Figure 1B:
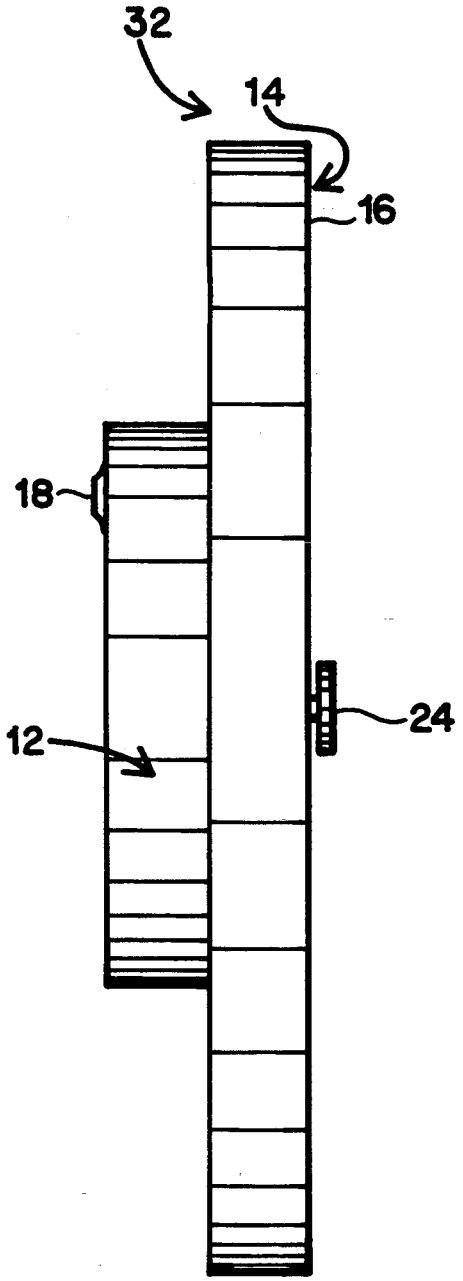
FIG. 1B is a left side view of the embodiment of FIG. 1A.

Referring to FIGS. 1A–5, there are shown some, but not the only, embodiments of the invented golf course timing method and system. Each timer includes a timing mechanism 12, which may be mechanical, electronic, electric, etc. The timing mechanism 12 is connected to a timer face 14 having an exterior surface 16. The exterior surface 16 may be similar, for example, to a traditional flat and round exterior surface of a clock face or may be of another shape. Each timer has a starting means 18 connected to the timing mechanism 12 and accessible by a golf course agent or other person wishing to start the timer. The starting means 18 may be a winding mechanism, a switch, or any means for starting a clock or timer.

Each timer includes a hole indicator that cooperates with the timing mechanism 12 to indicate what hole the golfer or flight of golfers should be playing at a given time after the start of the timer. The hole indicator may be of various designs and may be connected to and cooperating with the timing mechanism 12 in various ways, such as mechanical connection or electrical connection. The hole indicator may comprise hole indicia, such as hole markings 20 or blades 22, located on the exterior surface of the timer face and a pointing means, such as a sweeping clock hand 24 or a rotating cover 26, for pointing to or pointing out the hole indicia. Alternatively, the hole indicator may include an LED display of hole number and/or other information representing each golf course hole.

Figure 3:
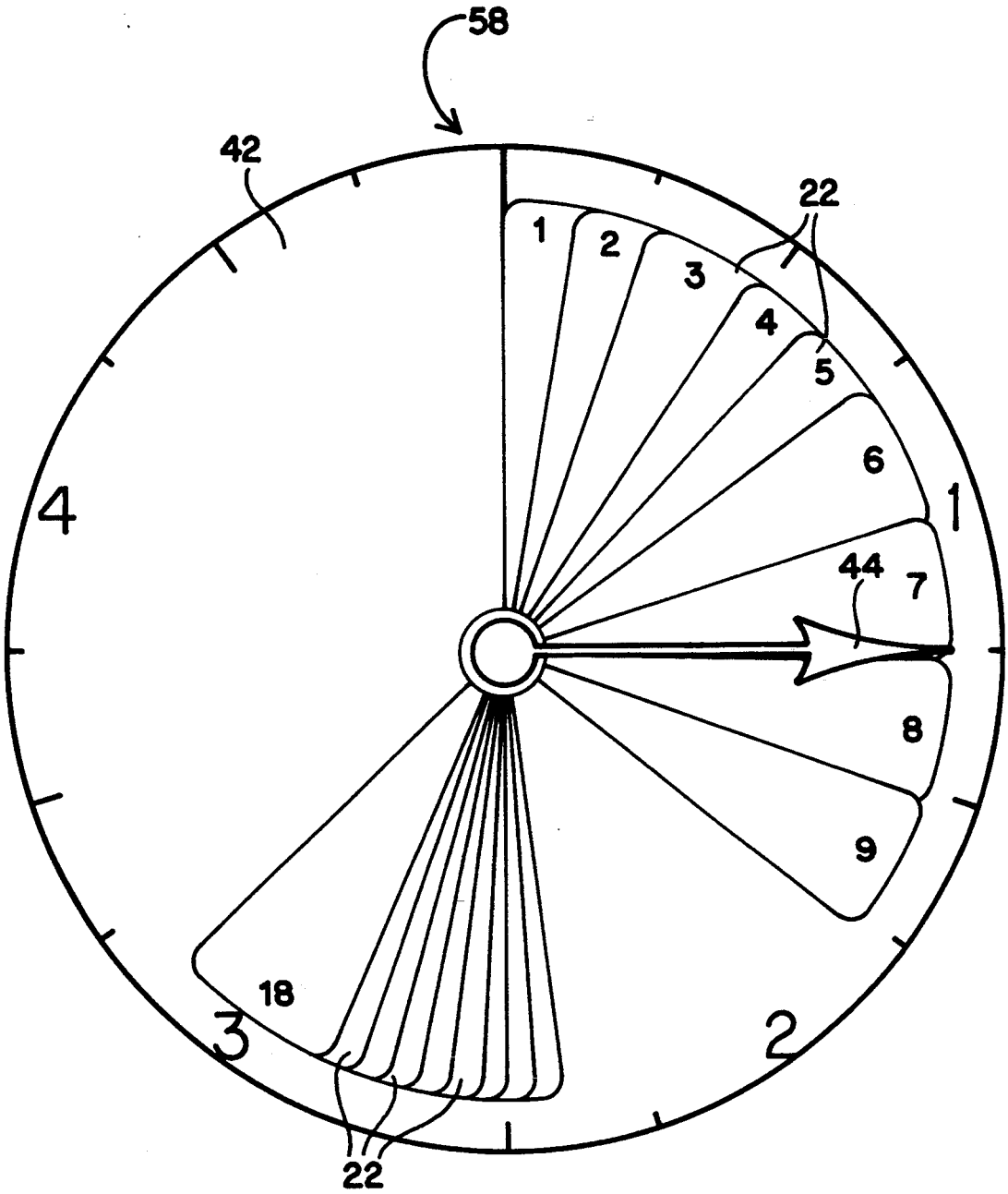
FIG. 3 is a front view of another embodiment of the timer device of the invention—a mechanical wind-down timer with a clockwise-moving hand and moveable blades on its face indicating the proper relationship between elapsed time and suggested position on the golf course.
Figure 4:
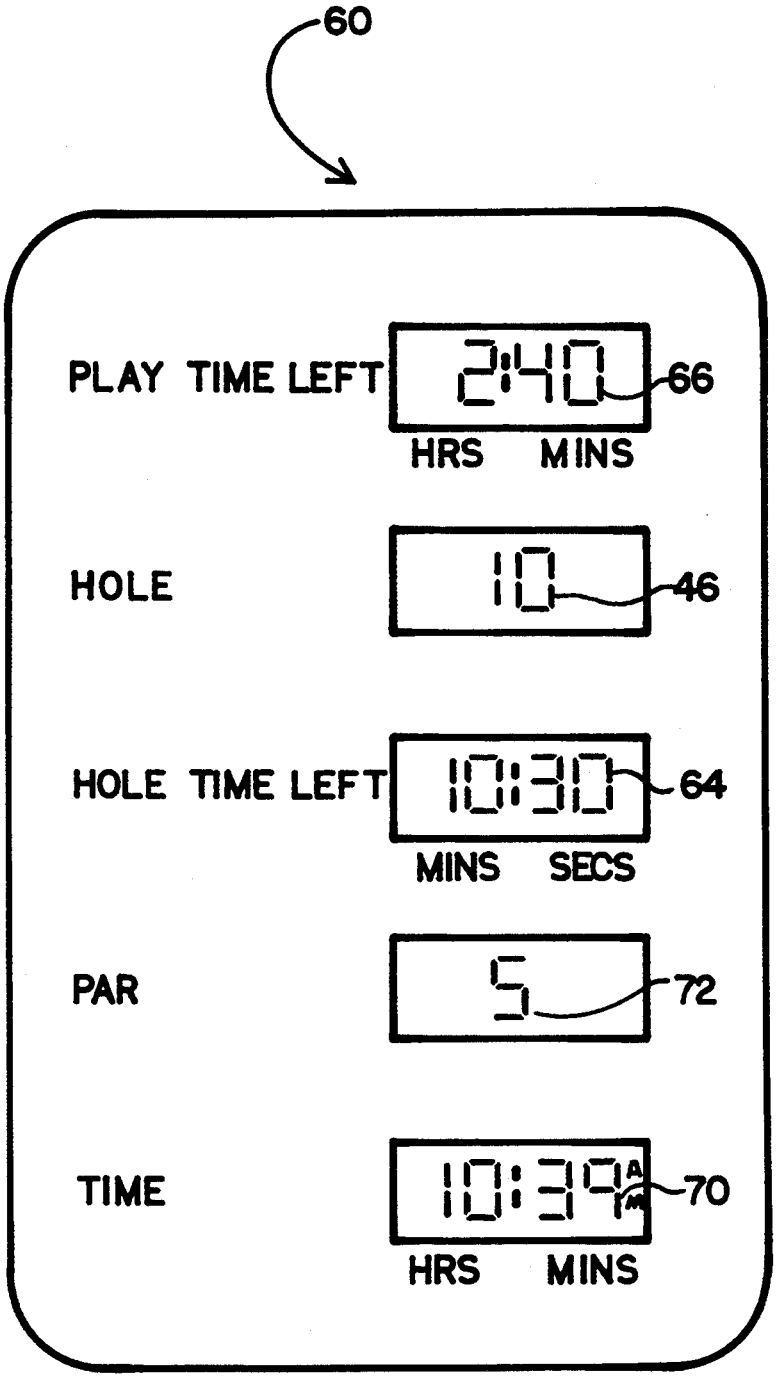
FIG. 4 is a front view of another embodiment of the timer device of the invention—an electronic, count-down timer with an LED display indicating, for example, time left to play and suggested position by hole and hole time left.
Figure 5:
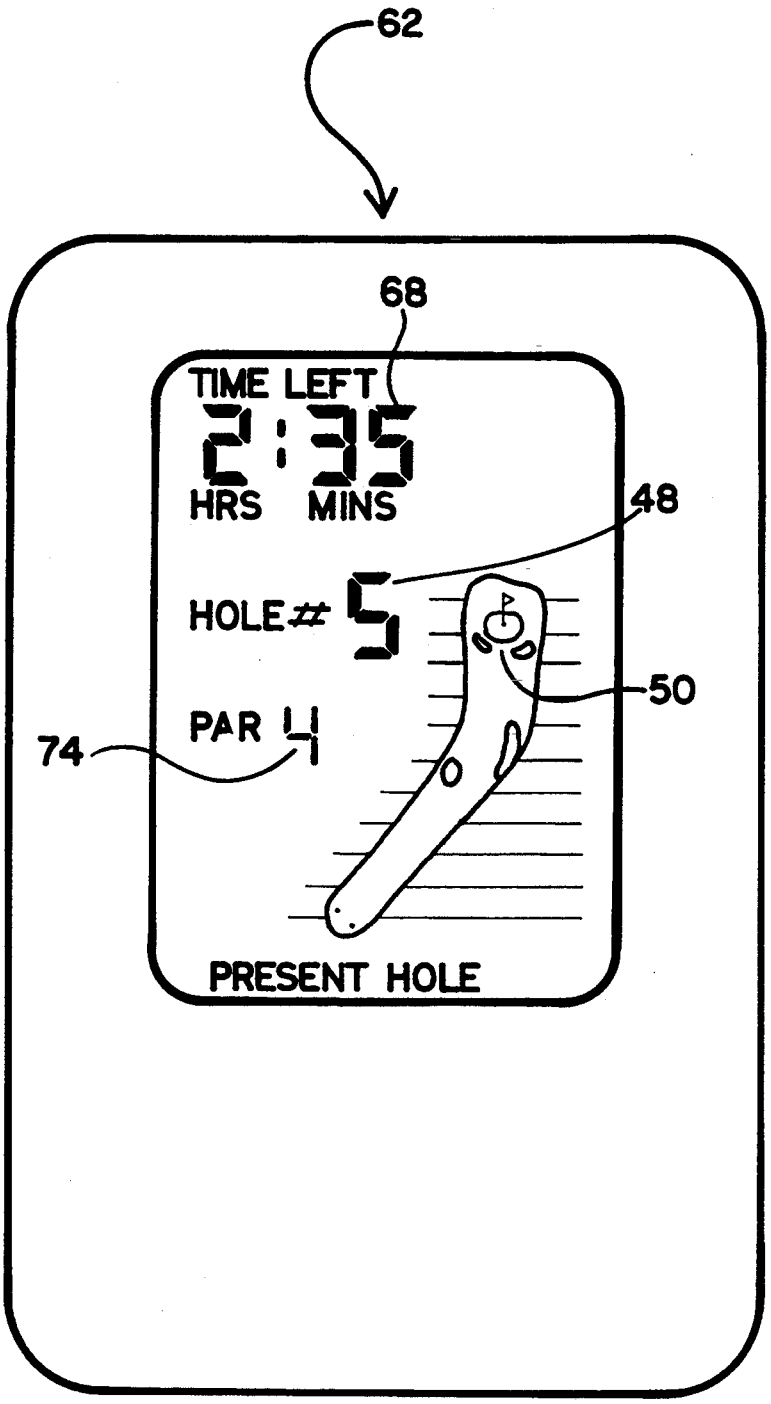
FIG. 5 is a front view of an embodiment similar to the one depicted in FIG. 4, except a diagram of the particular hole is also displayed.

For example, in the timer 32 shown in FIG. 1A, the hole indicator comprises hole markings 20 on the timer face exterior surface 16 and a sweeping clock hand 20 mechanically connected to the timing mechanism 12. In the timer 34 shown in FIG. 2, the hole indicator comprises hole markings 36 on the timer face exterior surface 38 and a rotating cover 26 with a window 40. In FIG. 3, the hole indicator comprises movable blades 22 on the timer face exterior surface 42 and a sweeping clock hand 44. In FIGS. 4 and 5, the hole indicators include an LED display of hole number 46, 48 and a diagram 50 of the hole.

Optionally, in addition to a hole indicator, the timer may also include a time indicator to indicate, for example, elapsed time since the start of the timer, time left to play the course, or time left to play the individual hole. A time indicator may comprise, for example, a clock hand pointing to time markings on the timer face, or an LED display of elapsed time, time to play, or standard time.

The timer 32 in FIG. 1A includes both hole indicator and time indicator. This timer 32 utilizes a timer face 14 similar to a circular clock face and a clock hand 24 that sweeps clockwise as the count-down timer operates.

The timer 32 is a 5-hour timer, with time markings 52 on the face to mark blocks of 15 minutes. In this 5-hour and 360 degree timer face, the passage of each minute is marked by the hand 24 sweeping 1.2 degrees.

While marking the passage of time, the sweeping hand 24 of the FIG. 1A timer 32 also points to the suggested hole and how far along in the play of the hole the golfer should be. The timer has hole indicia that comprises hole markings 20 for each of 18 holes. The hole markings 20 include segments 54 drawn on the circular timer face 14, each segment 54 having a width proportional to and covering the amount of time that should be spent on the respective hole. For example, in FIG. 1A, hole 1 is a short par 3 hole with a playing time of nine minutes. Hole 2 is a par 4 on a course rated 8 in difficulty and the play time from the tee box on number 2 to the tee box on hole number 3 is twelve minutes. There are 18 numbered segments 54 of various widths to reflect the maximum allowable playing time for each of 18 holes; plus a gap 56 to allow for a refreshment break. The maximum allowable playing time for each hole is determined in advance by the golf course management or pro and incorporated into the design of the hole markings 20.

Figure 2:
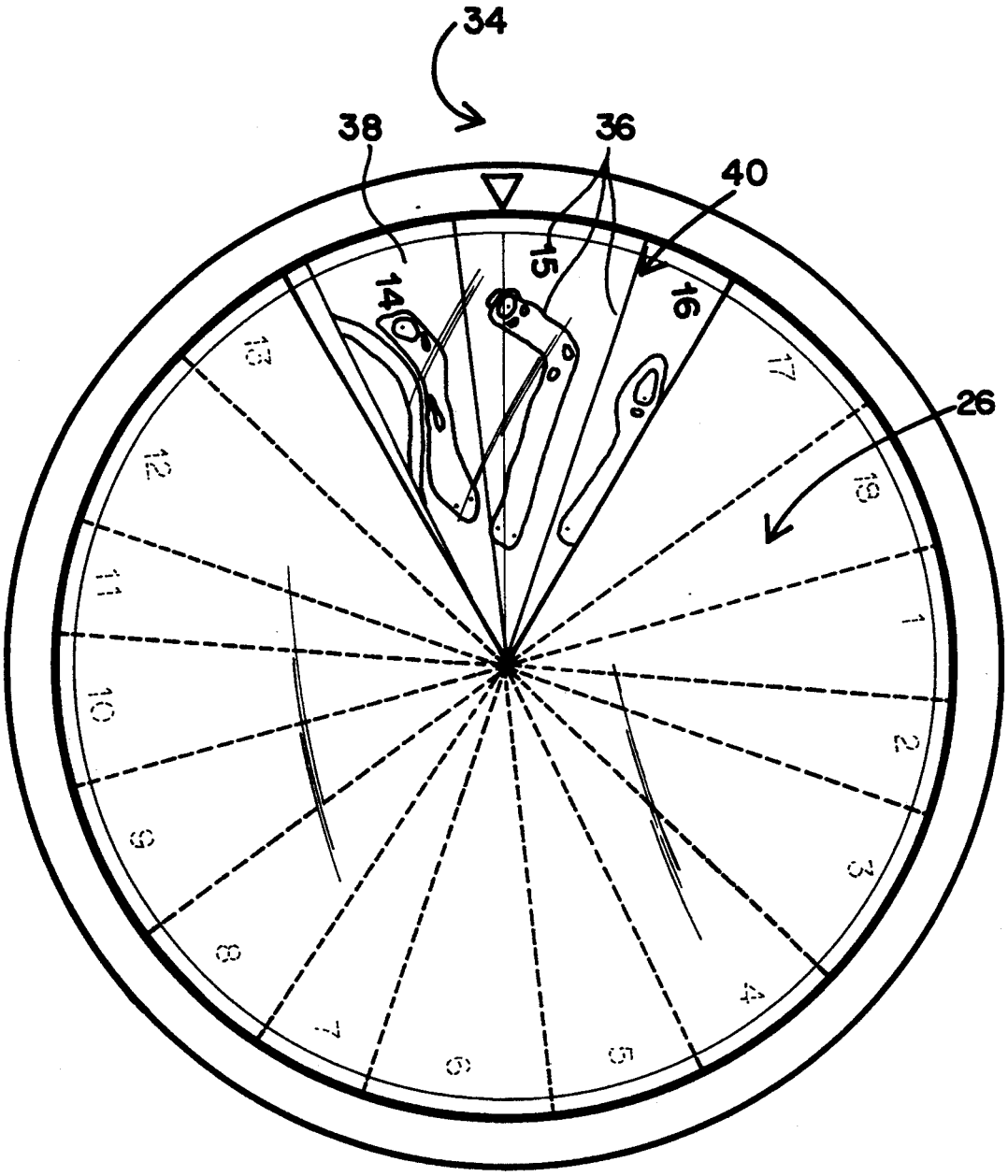
FIG. 2 is a front view of an embodiment similar to the one depicted in FIG. 1A, except a top cover with a window in it moves clockwise over a graphic design which schematically depicts the relationship between elapsed time and a particular hole on the course.

The hole indicia such as the hole markings 20, 36 in FIGS. 1A and 2 may be permanent designs that are custom made for a particular golf course. The hole markings may be printed on a disk that maybe removed from the timer face and replaced by another disk.

Alternatively, the hole indicia may be of a changeable design, for adaptation to any course, for changes in hole design of a particular course, or for the specific rules of a golf tournament or exhibition. An example of a changeable design is the timer 58 in FIG. 3; which has hole indicia that comprise 18 movable blades 22, each being a wedge shape pivotally fastened to the center of the timer 58 and having a width of about 20 minutes. The pro or course agent who sets the timer 58 may slide each blade 22 clockwise or counter-clockwise in order to position each blade 22 so that the hand 44 will sweep across the blade 22 at the appropriate time and for the appropriate length of time after play has started. The blades 22 preferably are designed so that they may be overlapped to make visible only the portion of each blade 22 that corresponds to the time allotted for each hole. For example, if hole 5 were allotted half the time that holes 4 and 6 were allotted, the blades 22 for holes 4, 5, and 6 would be overlapped so that half as much of the hole 5 blade would show compared to the blades for holes 4 and 6. For a hole with 20 minutes of allotted playing time, that hole's blade 22 would be positioned without other blades overlapping it. For periods of time over 20 minutes, for example, for a refreshment break between holes 9 and 10, a gap would be left between blades 22. For courses with playing times less than 5 hours, the remaining time up to 5 hours could be designated for clubhouse socializing.

The timer may also include par markings, which mark the strokes for par play of each hole. These par markings remind a golfer of his progress or lack of progress through a hole.

In FIGS. 4 and 5, electronic countdown timers 60, 62 include an LED digital display of information of interest to the golfers or the golf course agent. The hole number 46, 48 and the playing time remaining 64 for that hole are shown. Total play time remaining 66, 68 may be shown, as well as time of day 70. A display of par 72, 74 for the hole or a diagram 50 of the hole may be shown. These electronic timers 60, 62 may also be designed to transmit and/or receive information such as remaining times, hole number, and location. Such transmissions may be received by course personnel in the clubhouse or driving around the course. These transmissions may help the ranger more easily enforce the course rules by admonishing a flight of golfers to speed up or even by escorting a flight to another hole. In sophisticated models, a warning buzzer or voice command may be added that can be issued from the club house or ranger's cart to players who are falling behind.

The timing system may include timers carried by individual golfers and/or carried on golf carts being used by the flight of golfers. Smaller timers may be strapped to individual golf bags or pull-carts and larger timers may be strapped to the motorized carts. A course ranger may drive up to a golfer or a golf cart to check the flight's progress or may receive electronic transmissions from a distance and then approach a problem golfer or flight of golfers.

The golf course timing method involves setting the hole indicia of numerous countdown timers to correspond to the maximum allotted playing time for each hole, starting one or more timers and giving it/them to each flight of golfers as the flight begins play. The members of each flight are advised that their fees have "bought" a specific amount of time for a golf round and that they must abide by the schedule indicated by the timer. As each flight progresses through the course, the golfers note where they are playing relative to the timer, so that they hurry their play or move ahead without completing a hole in order to keep the flow of play fairly constant and smooth.

Alternatively, means other than a timer may be used to supply information to a golfer or flight of golfers regarding what hole they should be playing on at a given time. For example, a print-out of hole number versus time of day or versus elapsed time could be given to the golfers. The golfers would be assigned this information as their schedule and advised to refer to this printed information and to their wrist watches to keep on schedule during their play. As with the method using the timer, a course agent could monitor the progress of the golfers relative to the hole vs. time information supplied to them and would adjust their position on the course, if necessary, by escorting them or asking them to move. The timing method tends to prevent tension and bad feelings between golfers in different flights, between golfers within a flight, and between golfers and course personnel, because it provides a consistent and impersonal "authority" for the control of play. Also, the timing method gives a course ranger information upon which to base fair and consistent decisions.

While there is shown and described the present preferred embodiment of the invention, it is to be distinctly understood that this invention is not limited thereto but may be variously embodied to practice within the scope of the following claims.

I claim:

1. A golf course timer for use by golfers and golf course agents to regulate the time spent by the golfers on individual golf course holes, the timer comprising:

a timing mechanism for operating to measure passage of time;

a timer face connected to the timing mechanism, the timer face having an exterior surface;

a starting means connected to and cooperating with the timing mechanism and accessible by the golf course agent for starting operation of the timing mechanism to coincide with the golfer's start of play; and a hole indicator connected to the timer face exterior surface and visible to the golfer, the hole indicator for cooperating with the timing mechanism to indicate the hole of the golf course that the golfer should be playing at the time measured by the timing mechanism.

2. A golf course timer as set forth in claim 1, wherein the hole indicator comprises:

a plurality of hole markings on the exterior surface of the timer case, each hole marking corresponding to an individual golf course hole; and a clock hand connected to the timing mechanism and extending across the timer case exterior surface near the hole markings, the clock hand being driven by the operation of the timing mechanism to sweep across the exterior surface to point to the hole markings;

wherein the hole markings are arranged on the exterior surface so that the clock hand points to each hole marking at the time the golfer should be playing the corresponding golf course hole.

3. A golf course timer as set forth in claim 1, wherein the hole indicator comprises:

a plurality of hole markings on the exterior surface of the timer case, each hole marking corresponding to an individual golf course hole; and a cover connected to the timing mechanism and extending across the timer case exterior surface over the hole markings, the cover being driven by the operation of the timing mechanism to sweep across the exterior surface, the cover having a window through which each hole marking is visible as the window sweeps across it;

wherein the hole markers are arranged on the exterior surface so that the window sweeps over each hole marker at a time at which the golfer should be playing the corresponding golf course hole.

4. A golf course timer as set forth in claim 1, wherein the hole indicator comprises an LED display of the hole the golfer should be playing at the time measured by the timing mechanism.

5. A golf course timer for use by golfers and golf course agents to regulate the time spent by the golfers on individual golf course holes, the timer comprising:

a timing mechanism for operating to measure passage of time;

a timer face connected to the timing mechanism, the timer face having an exterior surface;

a starting means connected to and cooperating with the timing mechanism and accessible by the golf course agent for starting operation of the timing mechanism to coincide with golfer's start of play;

a plurality of blades on the exterior surface of the timer case, each blade representing and corresponding to an individual golf course hole, and each blade being slidably connected to the timer case so that the blades can be arranged on the exterior surface by being slid to touch, overlap, or be spaced apart;

a pointing means connected to the timing mechanism and extending across the timer case exterior surface, the pointing means being driven by the operation of the timing mechanism to sweep across the exterior surface and to point to the blades;

wherein the blades are arranged on the exterior surface so that the pointing means points out each blade at a time at which the golfer should be playing the corresponding golf course hole.

6. A golf course timer as set forth in claim 5, wherein the pointing means comprises a clock hand.

7. A golf course timer as set forth in claim 5, wherein the pointing means comprises a cover having a window through which each blade is visible as the window sweeps over it.

* * * * *